United States Patent [19]

Uchiyama et al.

[11] Patent Number: 4,462,842

[45] Date of Patent: Jul. 31, 1984

[54] SURFACE TREATMENT PROCESS FOR IMPARTING HYDROPHILIC PROPERTIES TO ALUMINUM ARTICLES

[75] Inventors: Toshimitsu Uchiyama; Eizo Isoyama; Hiroichi Takenaka; Masayuki Kaji, all of Sakai, Japan

[73] Assignee: Showa Aluminum Corporation, Osaka, Japan

[21] Appl. No.: 337,131

[22] Filed: Jan. 5, 1982

[30] Foreign Application Priority Data

| | | | |
|---|---|---|---|
| Aug. 13, 1979 | [JP] | Japan | 54-103305 |
| Jul. 7, 1980 | [JP] | Japan | 55-92962 |
| Jul. 7, 1980 | [JP] | Japan | 55-92963 |

[51] Int. Cl.[3] ..... C23F 7/00; C23F 7/08; B05D 3/02

[52] U.S. Cl. ..... 148/6.15 R; 148/6.14 R; 148/6.16; 148/6.2; 148/6.27; 427/318

[58] Field of Search ..... 148/6.15 R, 6.2, 6.16, 148/6.27, 6.14 R; 427/318

[56] References Cited

U.S. PATENT DOCUMENTS

| | | | |
|---|---|---|---|
| 2,157,155 | 5/1939 | Work et al. | 148/6.27 |
| 2,924,534 | 2/1960 | Arndt et al. | 148/6.27 |
| 3,096,220 | 7/1963 | Dalrymple et al. | 148/6.2 |
| 3,150,015 | 9/1964 | Boyer et al. | 148/6.2 |
| 3,351,504 | 11/1967 | DeHart | 148/6.2 |
| 3,391,032 | 7/1968 | Hansen et al. | 148/6.27 |
| 3,728,164 | 4/1973 | Abe et al. | 148/6.2 |
| 3,819,425 | 6/1974 | DeRidder et al. | 148/6.16 |
| 3,846,182 | 11/1974 | Huff et al. | 148/6.2 |
| 3,864,139 | 2/1975 | Heller | 148/6.15 |
| 3,989,550 | 11/1976 | Newhard | 148/6.16 |
| 4,017,334 | 4/1977 | Matsushima et al. | 148/6.27 |
| 4,086,092 | 4/1978 | Golda et al. | 148/6.27 |
| 4,111,722 | 9/1978 | Reghi et al. | 148/6.15 |
| 4,130,431 | 12/1978 | Kogure | 148/6.15 |
| 4,163,679 | 8/1979 | Nagae et al. | 148/6.15 |
| 4,204,919 | 5/1980 | Randall et al. | 148/6.27 |
| 4,313,769 | 2/1982 | Frelin | 148/6.27 |

*Primary Examiner*—Norman Morgenstern
*Assistant Examiner*—Janyce A. Bell
*Attorney, Agent, or Firm*—Armstrong, Nikaido, Marmelstein & Kubovcik

[57] ABSTRACT

An aluminum evaporator including a refrigerant tube and fins with a hydrophilic surface is prepared by forming a chemical coating over the surface of its components as assembled into a product or before fabrication, and thereafter forming a hydrophilic layer over the coating by treating the resulting components with a solution of silicic acid, silicate or colloidal silica.

5 Claims, 1 Drawing Figure

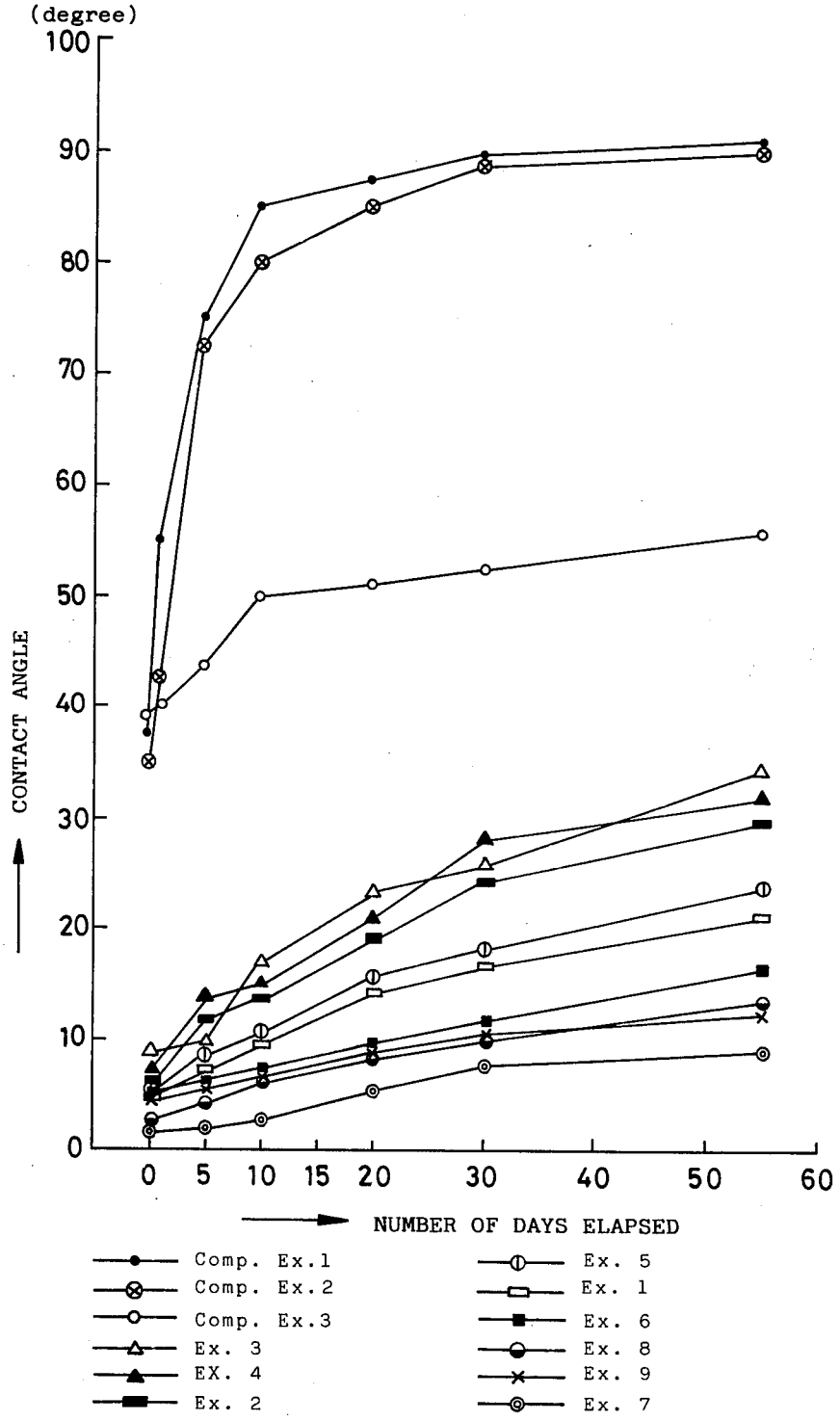
(degree)
100
90
80
70
60
50
40
30
20
10
0
CONTACT ANGLE
0
5
10
15
20
30
40
50
60
NUMBER OF DAYS ELAPSED
Comp. Ex.1
Comp. Ex.2
Comp. Ex.3
Ex. 3
EX. 4
Ex. 2
Ex. 5
Ex. 1
Ex. 6
Ex. 8
Ex. 9
Ex. 7

SURFACE TREATMENT PROCESS FOR IMPARTING HYDROPHILIC PROPERTIES TO ALUMINUM ARTICLES

BACKGROUND OF THE INVENTION

The present invention relates to a surface treatment process for imparting hydrophilic properties to aluminum articles, such as evaporators made of aluminum and pieces of aluminum material.

Throughout the specification and appended claims, the term "aluminum" includes pure aluminum, commercial aluminum containing small amounts of impurities and aluminum alloys in which aluminum predominates, and the term "aluminum articles" refers to aluminum products and aluminum materials.

Evaporators made of aluminum for air conditioners for motor vehicles and buildings include include refrigerant tubes and fins in combination therewith. While the evaporator is in operation, the refrigerant tube and fins have a surface temperature below the dew point, permitting deposition of water droplets or drops on the surfaces of these components. The deposition of water drops provides increased resistance to the flow of air which is forced through the evaporator from one side to the other side thereof. This reduces the overall amount of air flow through the evaporator to result in a reduced heat exchange efficiency. If it is attempted to obtain the desired amount of air flow, the evaporator must be made large-sized. In recent years, however, there is the tendency that the fins are arranged at a smaller spacing to render the heat exchanger more efficient and compacter. The arrangement therefore involves greater resistance to the air flow due to the deposition of water drops. The increased resistance is attributable to the fact that the conventional aluminum product, which is untreated, has poor hydrophilic properties, such that the drops of water deposited on the refrigerant tube and fins remain in shape. In some cases, such an aluminum article is chemically treated for the purpose of giving corrosion resistance thereto. As compared with untreated articles, the aluminum article with the resulting chemical coating has improved affinity for water, permitting the deposited water drops to spread, to some extent, in the form of a film on the surface of the article to somewhat decrease the resistance to the air flow, but the problem still remains as to the reduction of the heat exchange efficiency due to the deposition of water drops.

SUMMARY OF THE INVENTION

To overcome the above problem, the present invention provides a surface treatment process for imparting hydrophilic properties to aluminum articles which comprises a first step of forming a chemical coating over the surface of an aluminum article, and a second step of forming a hydrophilic layer over the coating by treating the resulting aluminum article with a solution of a compound selected from the group consisting of silicic acid, silicates and colloidal silica.

When the surface treatment process of this invention is used for evaporators, the droplets of water deposited on the refrigerant tube and fins immediately collapse to spread over the surfaces thereof in the form of a film, and the water flows down and is removed almost entirely. The portion of water remaining on the tube and fins due to surface tension is also in the form of a thin film and therefore will not impede the flow of air. Thus the present process eliminates the foregoing problem of the increased resistance to the flow of air resulting from the deposition of water drops, enabling the evaporator to achieve an improved heat exchange efficiency. Additionally the chemical coating formed on the aluminum article renders the article resistant to corrosion.

The first step of forming a chemical coating on the surface of an aluminum article is performed in the usual manner. Especially it is suitable to treat the aluminum article with an acid solution or zirconium fluoride solution, or with deionized water at 40° C. to boiling temperature, by immersion or spray. Water vapor, i.e. steam, is also usable for the treatment.

As the acid solution, it is preferable to use a solution of chromic acid, chromate, dichromate, chromic acid-phosphoric acid, phosphoric acid, phosphate, titanate or titanic acid-tannic acid. When the acid solution or zirconium fluoride solution is used, the article is treated generally for 5 seconds to 20 minutes.

Distilled water is usable as deionized water. Preferably the deionized water contains an amine, such as triethanolamine, to prevent precipitation of metallic oxides in the treating bath. It is further desirable that the deionized water have a pH of 6 to 13. When the pH is outside this range, aluminum will dissolve instead of providing the formation of a chemical coating. When deionized water or water vapor is used, the article is treated usually for 1 to 60 minutes.

The chemical coating formed by the first step provides a satisfactory undercoat for the hydrophilic layer to be formed by the subsequent step and further renders the article hydrophilic to some extent and highly resistant to corrosion. The article has higher corrosion resistance when treated with an acid solution than with deionized water. Accordingly the treatment with the acid solution is suited to evaporators for automotive air conditioners which are used in corrosive environments.

The solution for the second-step treatment is applied to the resulting article by immersion, spray or coating. Generally sodium silicate, potassium silicate and water glass are examples of silicates useful for the second step. The solution of silicic acid or a salt thereof has a concentration of 0.001 to 20% by weight, preferably 0.05 to 7% by weight. When having a concentration of less than 0.001% by weight, the solution fails to form a satisfactory hydrophilic layer over the chemical layer and therefore to give sufficient hydrophilic properties, whereas if the concentration exceeds 20% by weight, a precipitation occurs in the solution.

Preferably the solution of colloidal silica has a concentration of 0.001 to 40% by weight calculated as $SiO_2$, for the same reason as is the case with silicic acid and silicates. More preferably the concentration is 0.05 to 7% by weight.

It is desirable that the solution of silicic acid or a silicate have a pH of 6 to 13. If the pH is outside this range, the aluminum and chemical coating will dissolve at a higher rate than the formation of the hydrophilic layer.

The preferred pH of the colloidal silica solution is 2 to 13 for the same reason as is the case with the silicic acid or silicate solution.

The article is treated with such a solution in the second step preferably for 10 seconds to 10 minutes, although the time is dependent on the concentration of the solution. If the treating time is less than 10 seconds, it is impossible to obtain a satisfactory hydrophilic layer, whereas the hydrophilic properties obtained by 10 minutes' treatment will not be further improved even when the treatment is conducted for a longer period of time.

The hydrophilic layer is formed over the chemical coating of the first step as adsorbed thereto. Accordingly the chemical coating is not always covered with the hydrophilic layer completely but may remain exposed locally. In this case, the chemical coating, which is hydrophilic to some extent as stated above, serves to compensate for the local absence of the hydrophilic layer.

Further improved hydrophilic properties can be given to the aluminum article when the article is made rough-surfaced before the chemical coating, chemically as by etching or mechanically as by sandblasting.

BRIEF DESCRIPTION OF THE DRAWING

The drawing is a graph showing the relation between the number of days elapsed and the angle of contact of water determined for surface-treated aluminum articles.

EXAMPLES 1-12

Panels of aluminum according to JIS A-1100H24 and measuring 1 mm in thickness, 50 mm in width and 100 mm in length were used as aluminum articles. The panels were treated by first and second steps under the conditions listed below.

| Ex. No. | Treating liquid (concn., wt. %) | Temp. (°C.) | pH | Time (min) |
|---|---|---|---|---|
| | First step | | | |
| 1 | Chromic acid (2) | 30 | — | 3 |
| 2 | Chromic acid-phosphoric acid (3) | 40 | — | 1 |
| 3 | Tannic acid-titanic acid (5)* | 50 | — | 3 |
| 4 | Zirconium fluoride (2.5) | 50 | — | 5 |
| 5 | Zirconium fluoride (2.5) | 50 | — | 5 |
| 6 | Deionized water | 95 | 7 | 20 |
| 7 | Soln. of triethanolamine in deionized water | 95 | 10 | 15 |
| 8 | Same as above | 70 | 10 | 15 |
| 9 | Distilled water | 95 | 7 | 15 |
| | Second step | | | |
| 1 | Water glass (1) | 95 | 10 | 1 |
| 2 | Colloidal silica (5, calcd. as $SiO_2$) | 70 | 10 | 3 |
| 3 | Water glass (0.5) | 95 | 10 | 1 |
| 4 | Sodium metasilicate (0.05) | 95 | 10 | 1 |
| 5 | Colloidal silica (3, as $SiO_2$) | 70 | 10 | 3 |
| 6 | Sodium metasilicate (0.05) | 95 | 10 | 5 |
| 7 | Colloidal silica (3, as $SiO_2$) | 95 | 10 | 1 |
| 8 | Colloidal silica (5, as $SiO_2$) | 70 | 10 | 1 |
| 9 | Colloidal silica (7, as $SiO_2$) | 95 | 10 | 1 |

*Trade name: "BONDERITE 3750", product of Nippon Parkerising Co. Ltd.

COMPARISON EXAMPLE 1

The same procedure as in Example 1 was repeated except that the first step only was performed.

COMPARISON EXAMPLE 2

The same aluminum article as above was degreased with use of a 5 wt.% solution of NaOH at a temperature of 50° C. for 3 minutes.

COMPARISON EXAMPLE 3

The same aluminum article as above was subjected to anodic oxidation and then to sealing treatment in the usual manner.

The drawing shows the relation between the number of days elapsed and the angle of contact of water determined for the aluminum articles obtained in the foregoing examples and comparison examples. The drawing reveals that the aluminum articles of the examples are smaller in contact angle, i.e. greater in hydrophilic properties, than those of the comparison examples and remain free of deterioration for a prolonged period of time.

The surface treatment process of this invention may be practiced for assembled evaporators or for the tubes and plates for fabricating evaporators. The present invention, which has been described above for evaporators, is of course applicable to aluminum products and materials other than evaporators.

What is claimed is:

1. A surface treatment process for imparting hydrophilic properties at least onto fin surfaces of an aluminum evaporator consisting of a first step of forming a chemical coating over the surface of the aluminum thereof by treating the aluminum with a solution of zirconium fluoride, and a second step of forming a hydrophilic layer over the coating by treating the resulting aluminum article with a solution of colloidal silica.

2. A surface treatment process for imparting hydrophilic properties at least onto fin surfaces of an aluminum evaporator consisting of a first step of forming a chemical coating over the surface of the aluminum thereof by treating the aluminum with steam, and second step of forming a hydrophilic layer over the coating by treating the resulting aluminum article with a solution of colloidal silica.

3. A thin surface treatment process for imparting hydrophilic properties at least onto fin surfaces of an aluminum evaporator consisting of a first step of forming a chemical coating over the surface of the aluminum thereof by treating the aluminum with a solution of a member selected from the group consisting of chromic acid, chromates, dichromates, chromic acid-phosphoric acid, phosphoric acid, phosphates, titanates and tannic acid-titanic acid, and a second step of forming a hydrophilic layer over the coating by treating the resultant aluminum articles with a solution consisting of collodial silica, wherein the surface of the aluminum is roughened before forming the chemical coating.

4. A surface treatment process for imparting hydrophilic properties at least one fin surfaces of an aluminum evaporator consisting of a first step of forming a chemical coating over the surface of the aluminum thereof by treating the aluminum with deionized water at 40° C. to boiling temperature, and a second step of forming a hydrophilic layer over the coating by treating the resulting aluminum article with a solution of colloidal silica.

5. A process as defined in claim 4 wherein the deionized water contains an amine.

* * * * *